US007972083B2

(12) United States Patent
Jones

(10) Patent No.: US 7,972,083 B2
(45) Date of Patent: Jul. 5, 2011

(54) PILE DRIVING

(75) Inventor: Clive Jones, Dorset (GB)

(73) Assignee: Fast Frames (UK) Limited, Dorset (GB)

( * ) Notice: Subject to any disclaimer, the term of this patent is extended or adjusted under 35 U.S.C. 154(b) by 23 days.

(21) Appl. No.: 12/096,171

(22) PCT Filed: Dec. 1, 2006

(86) PCT No.: PCT/GB2006/004490

§ 371 (c)(1),
(2), (4) Date: Aug. 27, 2008

(87) PCT Pub. No.: WO2007/066078

PCT Pub. Date: Jun. 14, 2007

(65) Prior Publication Data

US 2009/0166092 A1 Jul. 2, 2009

(30) Foreign Application Priority Data

Dec. 6, 2005 (GB) ..... 0524825.7

(51) Int. Cl.
*E02D 13/04* (2006.01)

(52) U.S. Cl. ..... 405/232; 405/228

(58) Field of Classification Search ..... 405/227, 405/228, 232, 195.1, 224, 231, 223
See application file for complete search history.

(56) References Cited

U.S. PATENT DOCUMENTS

| | | | | |
|---|---|---|---|---|
| 3,832,858 | A * | 9/1974 | Anders | 405/232 |
| 6,354,767 | B1 * | 3/2002 | Jones | 405/232 |
| 6,749,371 | B2 * | 6/2004 | Jones | 405/232 |
| 6,994,493 | B2 * | 2/2006 | Jones | 405/232 |
| 7,585,133 | B2 * | 9/2009 | Jones | 405/228 |
| 2003/0077127 | A1 * | 4/2003 | Jones | 405/253 |
| 2005/0117976 | A1 * | 6/2005 | Jones | 405/231 |
| 2009/0129870 | A1 * | 5/2009 | Jones | 405/228 |

FOREIGN PATENT DOCUMENTS

| | | | |
|---|---|---|---|
| DE | 2840694 | A1 | 3/1980 |
| EP | 0424177 | A | 4/1991 |
| JP | 10102491 | | 4/1998 |
| WO | WO99/11872 | | 3/1999 |
| WO | WO01/92645 | A2 | 12/2001 |
| WO | WO03/074795 | | 9/2003 |

OTHER PUBLICATIONS

PCT Search Report.

* cited by examiner

*Primary Examiner* — Tara Mayo-Pinnock

(74) *Attorney, Agent, or Firm* — Kilpatrick Townsend & Stockton LLP

(57) ABSTRACT

A system for aligning a pile during pile driving, comprising: a pile (16) having a laterally protruding coupling (20) for a tether; and a pile guide (10) for supporting the pile as it is driven into a substrate, comprising a base frame (12) and a pile guide member (14) mounted on the base frame (12), the pile guide member (14) having in its periphery a slot (24) which is configured to allow the laterally protruding coupling (20) to pass therealong as the pile (16) passes through the pile guide; wherein the pile and pile guide member comprise two pairs of slidably interfitting profiles (52, 86) which are configured to resist gaping in the slot (24) of the pile guide member (14) as the pile (16) is driven therethrough into the substrate.

9 Claims, 5 Drawing Sheets

PILE DRIVING

BACKGROUND OF THE INVENTION

1. Field of the Invention

The invention relates to pile driving, and more particularly, but not exclusively, to underwater pile driving, e.g. for stabbing piles directly into the seabed.

2. Description of the Background Art

It is known to provide a guide for aligning a pile with the surface of a substrate into which the pile is to be driven and to provide stability for a piling hammer. Particularly when piling underwater there is the problem that after the pile has been introduced into the seabed or the like, the guide must be removed to allow the pile to be driven into its final position. This guide removal is time consuming and thus expensive. Accordingly, the present applicant proposed in International patent publication WO99/11872 a pile guide which allows pile driving to continue from start to finish without any need to interrupt driving to remove the guide. However, the pile guide disclosed in WO99/11872 may not be suitable with relatively short piles (less than 20 m in length) because a laterally protruding coupling for a tether located at the trailing end of such piles fouls the pile guide before a sufficient length of pile is embedded in the seabed to ensure stability.

In practice, it may also be important to orientate the pile so that its laterally protruding coupling will be aligned in a predetermined direction according to the intended use of the pile. A set pile orientation may be achieved using so-called orientation plates on the piles which engage a guide plate system in the pile guide member of the pile guide. The orientation plates are positioned on the piles in a known orientation relative to the tether/riggings couplings provided on the piles. In use, the orientation plates will engage the guide plate system as each mis-orientated pile is introduced into the pile guide member. The guide plate system forces the orientation plates to follow a helical path as the pile is further lowered through the pile guide member, causing the pile to rotate about its axis until the desired orientation relative to the base frame is achieved.

The present applicant has appreciated the need for a pile guide system that allows piles with laterally protruding couplings to be driven into a substrate, at least to a point where they are self supporting and stabilised, without fouling the pile guide.

DISCLOSURE OF INVENTION

In accordance with a first aspect of the present invention, there is provided a system for aligning a pile during pile driving, comprising: a pile having a laterally protruding coupling for a tether; and a pile guide for supporting the pile as it is driven into a substrate, comprising a base frame and a pile guide member mounted on the base frame, the pile guide member having in its periphery a slot which is configured to allow the laterally protruding coupling to pass therealong as the pile passes through the pile guide; wherein the pile and pile guide member comprise two pairs of slidably interfitting profiles which are configured to resist gaping in the slot of the pile guide member as the pile is driven therethrough into the substrate.

The slot in the pile guide member allows the pile to be driven further into the seabed without the laterally protruding coupling fouling the pile guide. The applicant is well aware that the pile guide member is inherently weak due to the presence of the slot in its periphery. Indeed, without remedial steps, it may be difficult to prevent a pile bursting out of the pile guide member through the slot during pile driving.

Accordingly, the solution proposed by the present invention is to use interfitting profiles on the pile and pile guide member which are configured to resist gaping of the slot. Specifically, two pairs of interfitting profiles are provided, with opposed surfaces in each pair of profiles abutting to prevent catastrophic outward movement of the pile guide member relative to the pile during piling.

Each pair of interfitting profiles comprises a first part mounted on the pile and a second part mounted on the pile guide member. The first parts may comprise a pair of elongate plates, aligned parallel to each other and to the longitudinal axis of the pile. The first parts may be spaced away from a leading end of the pile, towards the laterally protruding coupling. The first parts may be disposed substantially symmetrically either side of the laterally protruding coupling. The first parts may be angularly spaced apart by about 120° relative to the longitudinal axis of the pile, with the laterally protruding coupling therebetween.

The second parts may each define a surface aligned parallel to and facing away from the slot. For example, the surfaces may be part of flanges or grooves provided on the inner periphery of the pile guide member, adjacent and extending parallel to the slot. The surfaces may be disposed substantially symmetrically on opposite sides of the slot and subtend an angle of about 120° relative to a central axis of the pile guide member.

The pile and pile guide member may further comprise slidably interengagable profiles which are configured to axially rotate the pile to correct any misorientation of the laterally protruding coupling relative to the slot in the pile guide member, and/or maintain a predetermined orientation of the laterally protruding coupling relative to the slot in the pile guide member. Details of the slidably interengagable profiles are fully described in the present applicant's international application WO03/074795. Such slidably interengagable profiles include a member or members located towards the leading end of the pile so as to rotate the pile to align the coupling with the slot, and the pairs of interfitting profiles.

In accordance with a second aspect of the present invention, there is provided a pile for driving into a substrate, comprising: an elongate body with a longitudinal axis, a leading end and a trailing end; a laterally protruding coupling for a tether, the coupling being located towards the trailing end; and a pair of elongate plates mounted on the elongate body towards the trailing end, the elongate plates being parallel to each other and to the longitudinal axis of the elongate body, being disposed substantially symmetrically on opposite sides of the laterally projecting coupling, and being angularly spaced by about 120° relative to the longitudinal axis of the elongate body. Each elongate plate is configured to resist a force exerted on one side thereof in a circumferential direction away from the laterally projecting coupling.

A pile may also be envisaged, substantially as hereinbefore defined but without the laterally protruding coupling. Such a pile could be guided during pile driving with the pile guide as hereinbefore defined, with the slot in the pile guide member no longer essential to allowing the pile to be driven therethrough into the substrate.

BRIEF DESCRIPTION OF DRAWINGS

An embodiment of the invention will now be described by way of example and with reference to the accompanying drawings in which.

DESCRIPTION OF EMBODIMENT OF INVENTION

Figure 1:
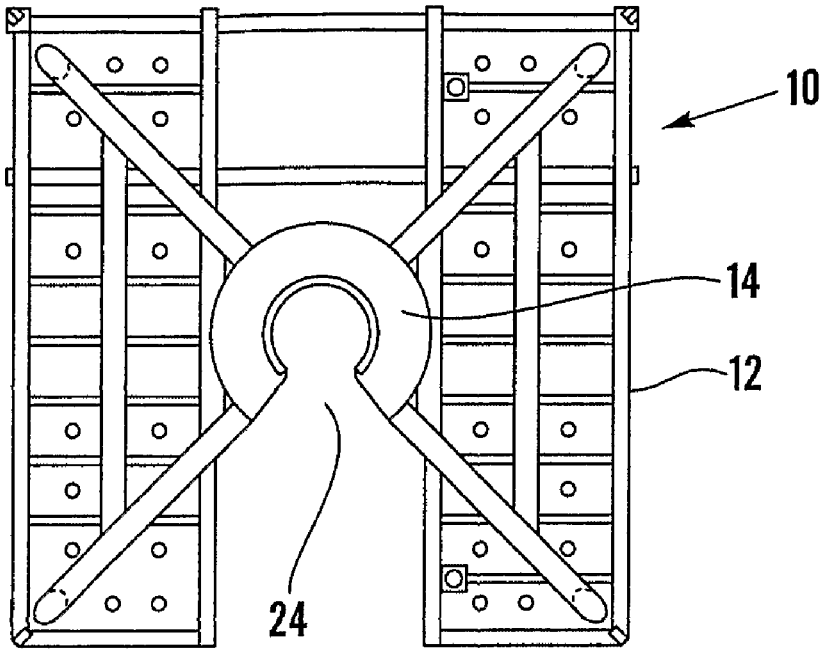
FIG. 1 is a plan view of a pile guide used in a system embodying the present invention.
Figure 2:
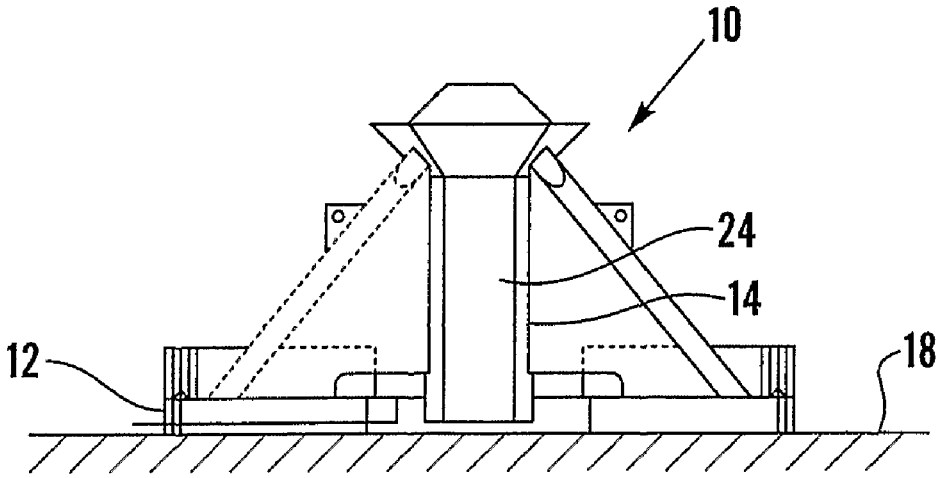
FIG. 2 is a front elevation of the pile guide of FIG. 1.
Figure 3:
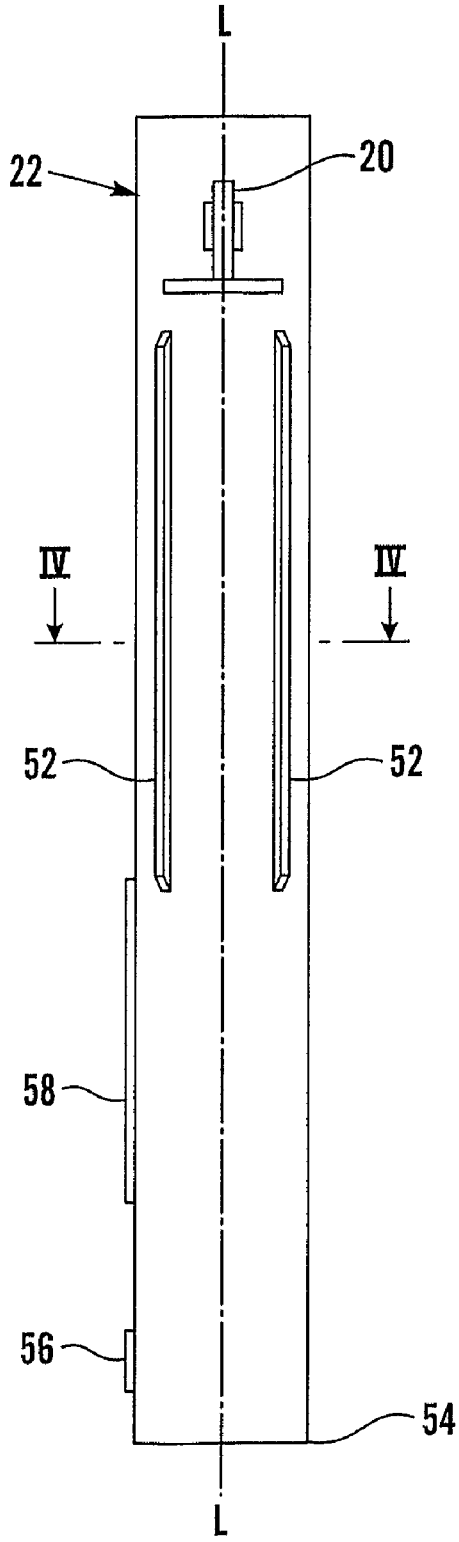
FIG. 3 is a schematic front elevation of a pile based in a system embodying the present invention.
Figure 4:
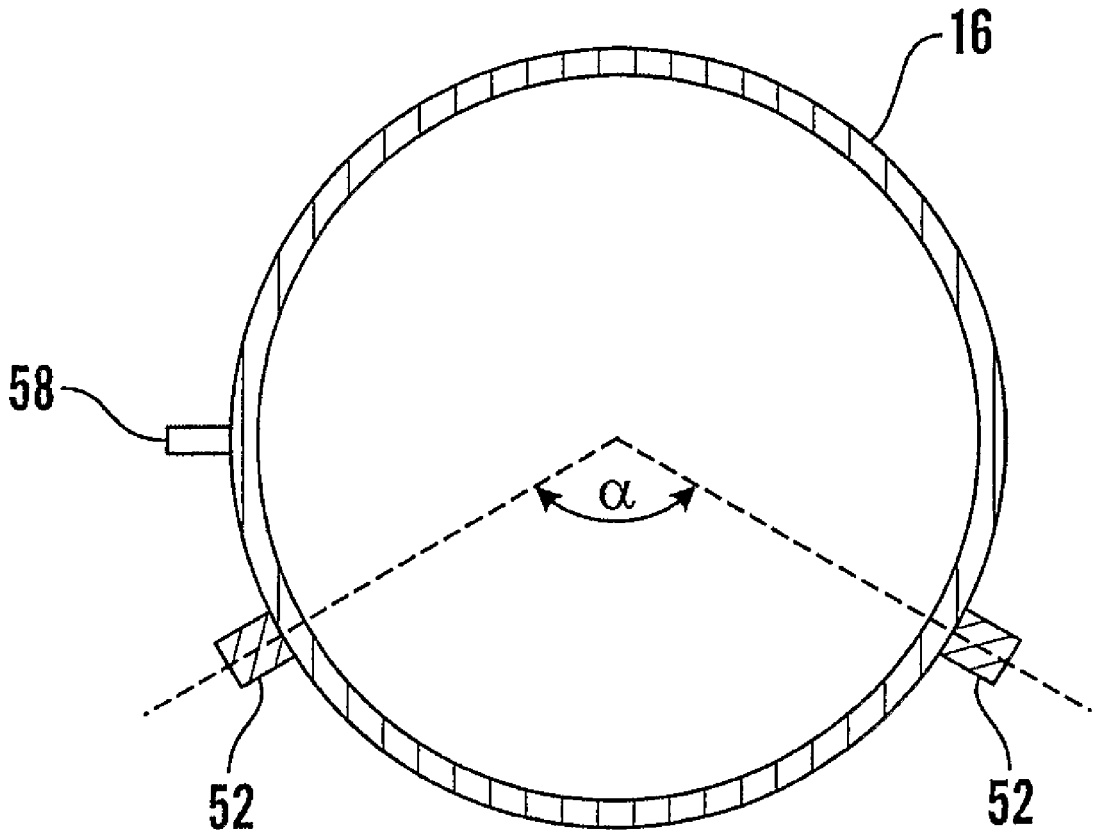
FIG. 4 is a schematic sectional view of the pile of FIG. 3 along line IV-IV.

FIGS. 1 and 2 show a pile guide (10) comprising a base frame (12) and a pile guide member (14) mounted on the base frame (12). A pile (16) as shown in FIG. 3 is supported by the pile guide member (14) whilst being driven into the substrate (18), e.g. a seabed. The pile (16) has a laterally protruding coupling (20) for a tether towards its trailing end (22). The pile guide member (14) has a slot (24) in its periphery to accommodate the coupling (20) as the pile (16) is driven into the seabed (18). The pile (16) and the pile guide member (14) have two pairs of interfitting profiles (see below) which are configured to resist gaping of the slot (24) as the pile (16) is driven into the seabed (18).

The Pile (16)

The pile (16) has a cylindrical body (50) with a pair of elongate plates (52) mounted thereon. Plates (52) are aligned parallel to each other and the longitudinal axis LL of the pile (16). The plates (52) are located away from a leading end (54) of the pile (16), towards coupling (20). The plates (52) are angularly spaced by about 120° (i.e. subtend an angle alpha of 120° at the longitudinal axis LL) and are symmetrically arranged around—but axially spaced from—the coupling (20). The pile (16) has additional parts (56,58) located towards the leading end (54) and in a known orientation relative to coupling (20) for correcting misorientation and maintaining corrected orientation of the pile (16) during pile driving. A complete description of the role of the parts (56,58) in correcting/maintaining orientation is included in International publication WO03/074795, so no further explanation shall be given in this specification.

The Pile Guide Member (14)

Figure 5:
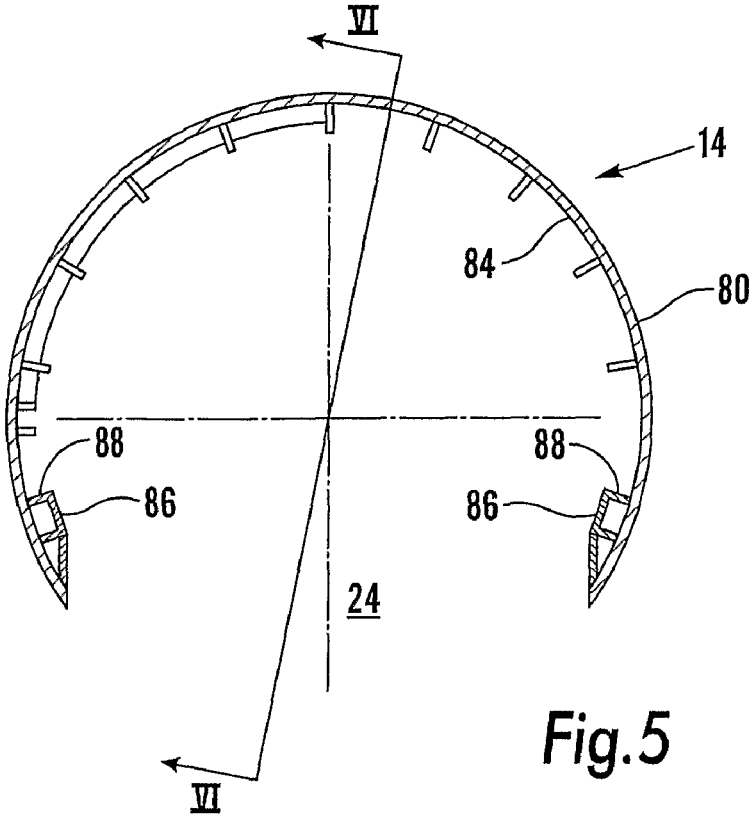
FIG. 5 is a sectional view showing detail of pile guide member of the pile guide of FIG. 1.
Figure 6:
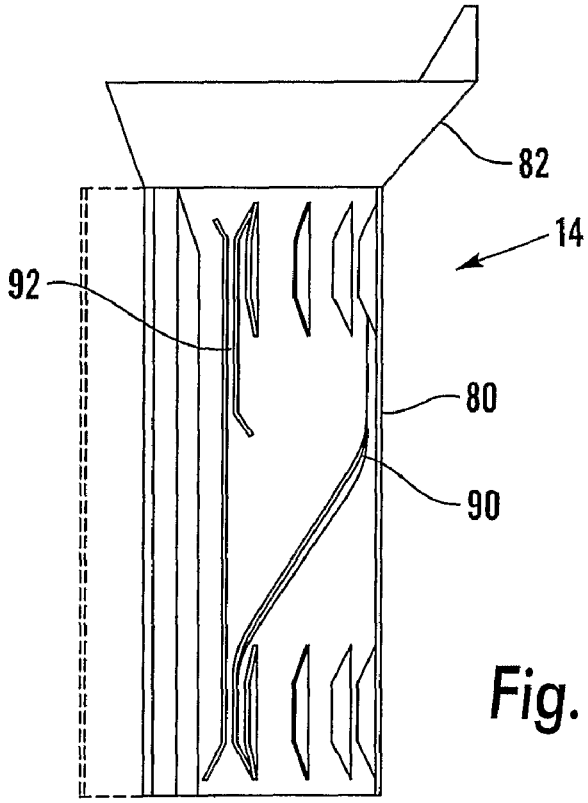
FIG. 6 is a schematic sectional view of the pile guide member of FIG. 5 along line VI-VI.

The pile guide member (14) has a generally cylindrical body (80) with a flared top opening (82). The slot (24) extends the full length of the body (80) and is wider than the coupling (20) to allow the latter to fit through the former as the pile (16) passes through the pile guide member (14), e.g. when lifting the pile guide (10) from around a pile (16) which has been driven into the seabed (18). The body (80) of the pile guide member (14) has a substantially C-shaped cross section as illustrated in FIG. 5. The body (80) has inner periphery (84) including reaction stops (86) disposed on either side of slot (24). Each reaction stop (86) defines a surface (88) facing away from the slot (24). The inner periphery (84) also includes parts (90,92) for engaging with parts (56,58) respectively on the pile (16) for correcting misorientation and maintaining corrected orientation of the pile (16) during pile driving. Once again a full description of the role of parts (90,92) is included in International publication WO03/074795, so no further explanation shall be given in this specification.

Figures 7A, 7B:
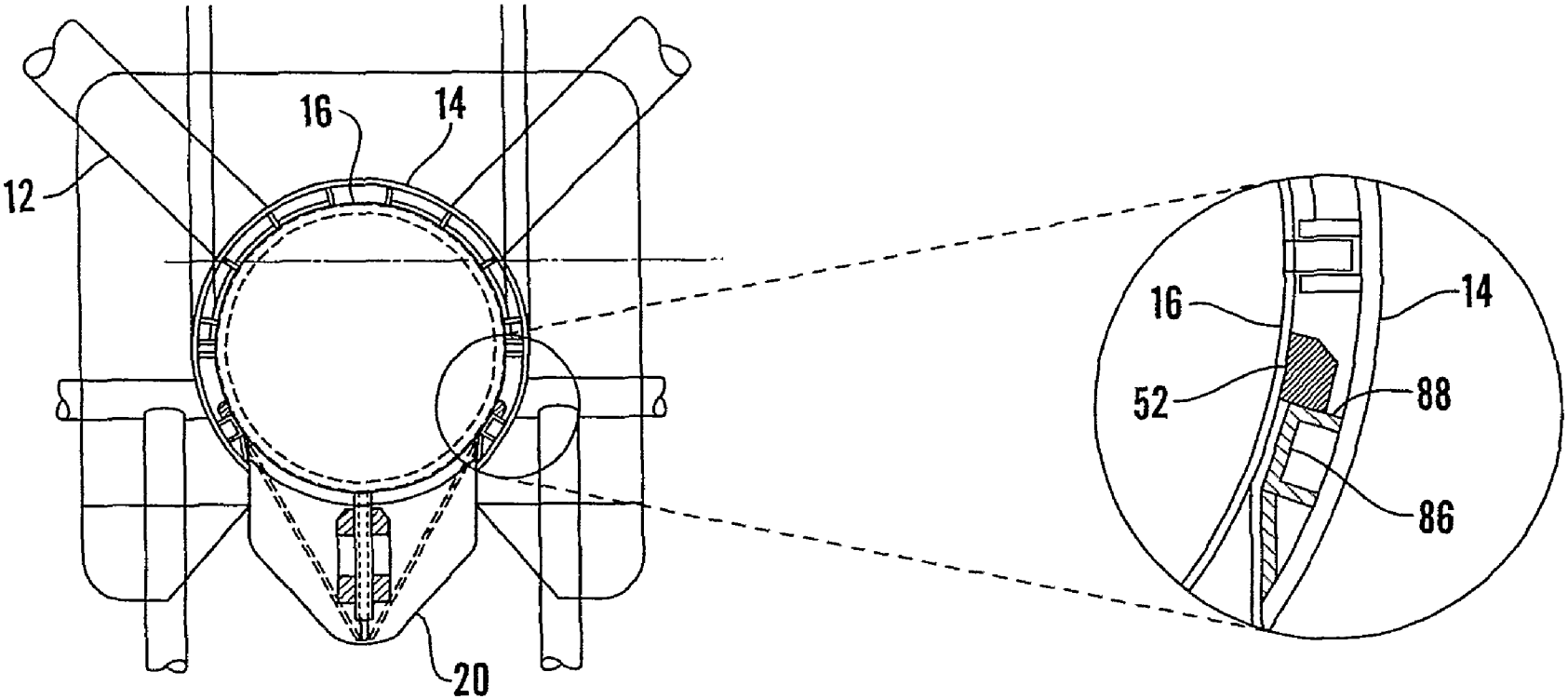
FIG. 7*a* is a partial sectional view showing the pile of FIG. 3 in the pile guide of FIG. 1.
FIG. 7*b* shows detail of interfitting parts of the pile and pile guide of FIG. 7*a*.

In use, the pile guide (10) is positioned on the seabed (18) with slot (24) orientated according to the direction in which the tether coupling (20) of the pile (16) is going to be aligned. A pile (16) is then introduced into pile guide member (14). Interengagement between parts (56,58) and on the pile (16) and parts (90,92) on the inner periphery (84) of the pile guide member (14) ensure that the coupling (20) is brought into alignment with slot (24) as shown in FIG. 7*a*. As the pile (16) is further introduced into the pile guide member (14), the plates (52) snugly interfit with the reaction stops (86). If the pile (16) exerts a "bursting" force on the pile guide (14) in the direction of slot (24), the surface (88) of the reaction stops (86) will bear against the plates (52) and resist outward movement of the pile guide member (14) relative to the pile (16).

In this way, the pile guide member (14) relies upon the pile (16) to enhance its stability and rigidity.

The invention claimed is:

1. A system for aligning a pile during pile driving, comprising: a pile having a laterally protruding coupling for a tether; and a pile guide for supporting the pile as it is driven into a substrate, comprising a base frame and a pile guide member mounted on the base frame, characterised in that the pile guide member has in its periphery a slot which is configured to allow the laterally protruding coupling to pass therealong as the pile is guided through the pile guide; and in that the pile and pile guide member comprise two pairs of slidably interfitting profiles which are configured to resist gaping of the slot of the pile guide member as the pile is driven therethrough into the substrate, wherein the pile guide member has a longitudinal axis, wherein the slot has two laterally spaced-apart edges relative to the longitudinal axis of the pile guide, wherein, during pile driving, one pair of the slidably interfitting profiles is laterally spaced-apart from the other pair of slidably interfitting profiles relative to the longitudinal axis of the pile guide member such that one pair of the slidably interfitting profiles is near one edge of the slot and the other pair of slidably interfitting profiles is near the other laterally spaced-apart edge of the slot.

2. A system according to claim 1, in which each pair of interfitting profiles comprises a first part provided on the pile and a second part provided on the pile guide member.

3. A system according to claim 2, in which the first parts comprise a pair of elongate plates mounted on the pile, the elongate plates being angularly spaced apart and aligned parallel to the longitudinal axis of the pile.

4. A system according to claim 2, in which the first parts are spaced away from a leading end of the pile, towards the laterally protruding coupling.

5. A system according to claim 2, in which the first parts are disposed substantially symmetrically on opposite sides of the laterally protruding coupling.

6. A system according to claim 2, in which the first parts are angularly spaced apart by about 120° relative to the longitudinal axis of the pile.

7. A system according to claim 2, in which the second parts each define a surface aligned parallel to and facing away from the slot.

8. A system according to claim 7, in which the second parts comprise a flange or groove provided on the inner periphery of the pile guide member.

9. A system according to claim 7, in which the surfaces are disposed substantially symmetrically on opposite sides of the slot, with an angular spacing between the surfaces of about 120° relative to a central axis of the pile guide member.

* * * * *